US009120653B2

(12) United States Patent
Bohnacker et al.

(10) Patent No.: US 9,120,653 B2
(45) Date of Patent: Sep. 1, 2015

(54) METHOD OF MONITORING CRANE SAFETY DURING THE SETUP PROCEDURE, AS WELL AS CRANE AND CRANE CONTROL

(75) Inventors: Roland Bohnacker, Blaubeuren (DE); Max Kenzelmann, Schelkingen (DE); Helmut Spaeth, Schelkingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 319 days.

(21) Appl. No.: 13/493,192

(22) Filed: Jun. 11, 2012

(65) Prior Publication Data

US 2012/0312767 A1 Dec. 13, 2012

(30) Foreign Application Priority Data

Jun. 10, 2011 (DE) ..... 10 2011 103 953
Jul. 18, 2011 (DE) ..... 10 2011 107 754

(51) Int. Cl.

| | |
|---|---|
| ***B66C 13/46*** | (2006.01) |
| ***B66C 23/88*** | (2006.01) |
| ***B66C 23/90*** | (2006.01) |
| ***B66C 23/82*** | (2006.01) |

(52) U.S. Cl.

CPC ..... *B66C 23/90* (2013.01); *B66C 13/46* (2013.01); *B66C 23/82* (2013.01)

(58) Field of Classification Search

CPC ..... B66C 13/18; B66C 15/06; B66C 15/065; B66C 23/88; B66C 2700/084; B66C 13/46

USPC ..... 212/276, 277, 278, 280, 270

See application file for complete search history.

(56) References Cited

U.S. PATENT DOCUMENTS

| | | | | |
|---|---|---|---|---|
| 3,740,534 | A * | 6/1973 | Kezer et al. | 701/50 |
| 4,063,649 | A * | 12/1977 | Hubbard et al. | 212/278 |
| 5,731,974 | A * | 3/1998 | Pietzsch et al. | 700/83 |
| 6,170,681 | B1 * | 1/2001 | Yoshimatsu | 212/278 |
| 6,587,795 | B2 * | 7/2003 | Schmid | 702/42 |
| 6,588,610 | B2 * | 7/2003 | Ong et al. | 212/275 |
| 7,729,832 | B2 * | 6/2010 | Benckert et al. | 701/49 |
| 2005/0258122 | A1 * | 11/2005 | Morath | 212/294 |
| 2007/0027613 | A1 * | 2/2007 | Abel et al. | 701/124 |
| 2010/0044332 | A1 * | 2/2010 | Cameron | 212/278 |

FOREIGN PATENT DOCUMENTS

| | | | |
|---|---|---|---|
| DE | 29924989 | U1 | 12/2007 |
| GB | 2353514 | A | 2/2001 |

* cited by examiner

*Primary Examiner* — Emmanuel M Marcelo
*Assistant Examiner* — Justin Stefanon
(74) *Attorney, Agent, or Firm* — Dilworth & Barrese, LLP.

(57) ABSTRACT

The present invention relates to an angle-related method of monitoring crane safety during the setup procedure of a crane, wherein the crane has a sensor system and a crane control and the crane control receives one or more measured values from the sensor system during the setup procedure and compares the measured value or values received with at least one corresponding limit value and triggers a measure on an exceeding and/or falling below of the limit value or values.

22 Claims, 4 Drawing Sheets

METHOD OF MONITORING CRANE SAFETY DURING THE SETUP PROCEDURE, AS WELL AS CRANE AND CRANE CONTROL

BACKGROUND OF THE INVENTION

The invention relates to a method of monitoring the crane safety of a crane, wherein the crane has a sensor system and a crane control.

In the more recent past, the demands on the crane safety of a crane during crane operation have been growing all the time, which is partly due to new statutory provisions. Modern lifting apparatus therefore have a crane control for monitoring the crane safety during crane operation. Various sensors provide the crane control with data during the crane work which relate, for example, to the angular position of individual boom elements or to the transmitted forces in the individual components.

The crane control requires the received data for load moment limitation during the crane work to foresee a tilting of the crane or a failure of the supporting structure of the crane and to introduce counter-measures in an emergency. Comprehensive statutory and standard provisions exist for such safety mechanisms.

The load moment limitation is in this respect usually determined in that measured values are detected and forwarded to the control. The control carries out a calculation of the load which is suspended at the crane hook, with the control calculating out the inherent weights contained in the measured value and thereupon determines the load at the hook from the residual remainder of the measured parameter. In this observation, the tolerances of the inherent weights must be observed. With shallow boom positions and small loads at the hook—a situation which occurs, for example on the erecting or setting up of the crane—the impact of these tolerances is out of all proportion.

In contrast to the crane work monitored by the control the setting up of the crane has previously not been subject to any complete monitoring. Setting up is understood as the establishing of the work capability of the crane, such as the assembly of the crane from the transport state into the working state. The setting up procedure is concluded when the crane is in a payload table applicable to the usage.

As described above, the safety demands on the crane operation are intensified regularly to reduce the danger to involved persons as much as possible on the handling of the machines. In the meantime, new provisions have therefore been set up which also require a maximum possible safety status during the setting up procedure of a crane.

If now, however—as required by the new provisions—the setting up process also has to be monitored by the control, the control must already intervene at a very early time although the crane is still by no means at full capacity. It is in particular necessary for the increasingly required setting up case in which long and heavy booms are to be erected to utilize the possible load limits of the crane.

SUMMARY OF THE INVENTION

The present invention has therefore set itself the goal of taking account of the provisions raised and to develop a method to the effect that an automated monitoring of crane safety during the setting up process is made possible. This automatic monitoring during the setting up process should in particular have a higher precision to be able also to erect booms which are as long and as heavy as possible with respect to the payload of the crane.

An angle-related method is proposed for achieving this object for monitoring crane safety during the setting up process having the features herein. The method in accordance with the invention requires that the crane includes a sensor system and a crane control which are in communication with one another. The crane configuration is irrelevant for the carrying out of the method; the method can therefore be used without limitation equally with mobile cranes or stationary cranes with lattice booms or telescopic booms.

The crane control receives one or more measured values from the sensor system of the crane on the angular position during the setting up process and compares at least one received measured value with at least one corresponding limit value. An angle-related monitoring is therefore realized in accordance with the invention. This angle-related monitoring allows the direct use of the measured values without calculating down to a load on the hook.

An advantage of the angle-related method is that negative angles can also be considered in the setting up of a boom in the control. This is not possible with a purely outreach-related calculation since an angle of the boom negative with respect to the horizontal produces the same outreach as the corresponding positive angle with respect to the horizontal. Furthermore, with shallow angular positions of the boom system, an angular change only effects a small change in outreach due to the geometry, which results in a more accurate imaging of the real load.

If the received measured value exceeds or falls below the corresponding limit value, a measure is triggered during the setting up process by the crane control.

The received measured values can preferably be understood as actual values which are analyzed by the control by comparison with the corresponding limit value.

The crane control can trigger a response in dependence on the comparison result. A suitable response can preferably be a speed reduction or a complete emergency stop of at least one crane movement during the setting up process. It is also conceivable to respond in dependence on the comparison result by output of at least one acoustic and/or optical warning signal.

Signal colors such as red or yellow are suitable as warning signals which signal the occurrence of a danger source during the setting up process to the crane operator in an easily perceivable manner.

One or more limit values are preferably stored in tabular form either directly in the crane control or can be called up by the crane control from an external storage medium. The table preferably includes limit values which are dependent on the setup state and which characterize specific limit values for a setup state of the crane adopted at the specific point in time.

The limit value dependent on the setup state also relates, in addition to the position of the crane elements which are adopted at the specific point in time and which are in particular movable during the setup procedure, such as the boom system, to the detailed setup configuration selected in advance, i.e. the assembled boom combination of the crane. The limit values depending on the setup state accordingly vary with each possible movement progress of individual crane components during the setup procedure. One or more individual limit values dependent on the setup state accordingly exist for every possible point in time for a resolution which is as high as possible.

In this connection, it is conceivable that individual limit values dependent on the setup state are entered into the table for all possible setup states, i.e. boom positions or boom combinations. Due to the possible number of valid combination possibilities during the setup procedure, an extremely large number of table entries is required. Against this background, it may be expedient to store a specific selection of limit values dependent on the setup state for specific setup states and to determine the remaining and absolutely necessary limit values dependent on the setup state from the existing data set with the aid of a mathematical calculation method. Conclusions can advantageously be drawn on necessary and unknown limit values depending on the setup state by interpolation while taking account of existing limit values dependent on the setup state.

The sensor system of the crane as a rule comprises one or more sensors which are arranged at different points, in particular points relevant to the setup procedure and continuously transmit one or more measured values to the crane control for monitoring safety. One or more sensors which are configured for detecting the holding force are preferably attached to at least one movable boom element. The force introduced into the guying frame is preferably detected by means of a load cell. It can take place in dependence on the setup state by a load cell in the guying toward the main boom or also in a crane in a derrick configuration by a load cell in the guying toward the derrick boom.

In the meantime, a force measurement in the region of the luffing ram has proved to be advantageous in crane configurations with telescopic booms to provide the required measured holding force in a movable boom element to the crane control for the monitoring of the crane safety.

There is furthermore the possibility of measuring the force in the guying toward the luffing fly boom and the force in the guying toward the luffing rope arrangement of the main boom by corresponding sensors or load cells and to communicate it to the crane control. In this connection, it must be noted that the existence of the individual sensors or load cells is dependent on the respective crane configuration. It is therefore expedient that such information is known to the crane control and said crane control only expects and takes into account for the comparison the forces relevant to the respective configuration or the values representing them on the basis of this information.

In derrick operation of the crane, the force introduced into the derrick boom by the derrick ballast can also be a possible measured value which is provided by the sensor system to the crane control.

Provision can be made in a further advantageous embodiment of the method that the crane control receives at least one measured value from at least one angular sensor and uses it for a comparison with a suitable limit value. One possibility is that the sensor system includes one or more angular sensors which determines, for example, the angular position of one or more movable crane elements, in particular boom elements. The horizontal is preferably selected as the reference line for determining the angle.

The angular position of the main boom and/or of the luffing fly boom and/or of the derrick boom or of the crane undercarriage are preferably to be taken into account as specific measured values.

Optionally, the wind strength determined via a sensor system procedure can additionally be taken into account during the setup for the determination of crane safety. The measured value determined can likewise be compared with a corresponding limit value or can be otherwise taken into the determination of the crane safety.

The method in accordance with the invention can preferably not only determine the exceeding or falling below of a limit value, but can also recognize the potential risk of tilting and/or a material overload of individual crane components in dependence on one or more comparisons. There is furthermore the possibility of recognizing an exceeding of the permitted ground pressure on the use of the method in accordance with the invention with crawler cranes. The recognized events preferably trigger a suitable measure as a response. A suitable control and/or regulation measure of the crane control can be made as a response during the setting up process or, alternatively or additionally, the output of an acoustic or optical warning signal can be triggered.

It may optionally be necessary to provide the crane control with data with respect to the planned crane configuration which permit a possible determination or calculation of the potential risk of tilting, of a material overload and of an exceeding of the permitted ground pressure. Under this aspect, in particular information on the type of crane ballast used and/or of the crane weight and/or of the geometrical dimension of the crane footprint is significant, which applies equally to the boom combination used. The combination of these data, which are preferably provided to the crane control manually by user input, with the data supplied to the crane control continuously by the sensor system in conjunction with the subsequent comparison with one or more limit values allows a reliable and sufficiently accurate recognition of a potential risk of tilting and/or of a material overload and/or of a dangerous exceeding of the permitted ground pressure.

The crane control preferably processes the measured value or values related to the holding force and converts them into an actual payload. In addition, the crane control converts the associated angle-related maximum permitted limit value to a maximum possible payload. At least one of these values is displayed in the form of a capacity bar. Particularly preferably, both values are displayed in relation to one another.

The invention further relates to a crane, in particular to a mobile crane or to a crawler-mounted crane, which includes either a telescopic boom or a lattice boom. In accordance with the invention, the crane has a sensor system and a crane control for carrying out the aforesaid method in accordance with the invention in one of the advantageous embodiments. The crane in accordance with the invention in this respect evidently has the same advantages and properties as the method in accordance with the invention so that a repeat description will be dispensed with at this point.

It is expedient that the crane includes one or more arranged load cells and/or an angle meters and/or wind gauges which are in communication with the crane control and provide the technical requirements for the carrying out of the method in accordance with the invention.

Furthermore, the invention relates to a crane control for a crane, in particular for a crane in accordance with the above embodiment, wherein the crane control is configured for carrying out the method in accordance with the invention in accordance with one of the advantageous embodiments.

BRIEF DESCRIPTION OF THE DRAWINGS

Further advantages and particulars of invention will be explained in detail with reference to embodiments shown in the drawings. There are shown.

DESCRIPTION OF THE PREFERRED EMBODIMENTS

The invention provides a method to monitor the crane independently of the selected crane configuration also during the setting up. In this respect, the sensors anyway present on the crane are used which are as a rule available for monitoring crane safety during crane operation.

Figure 1:
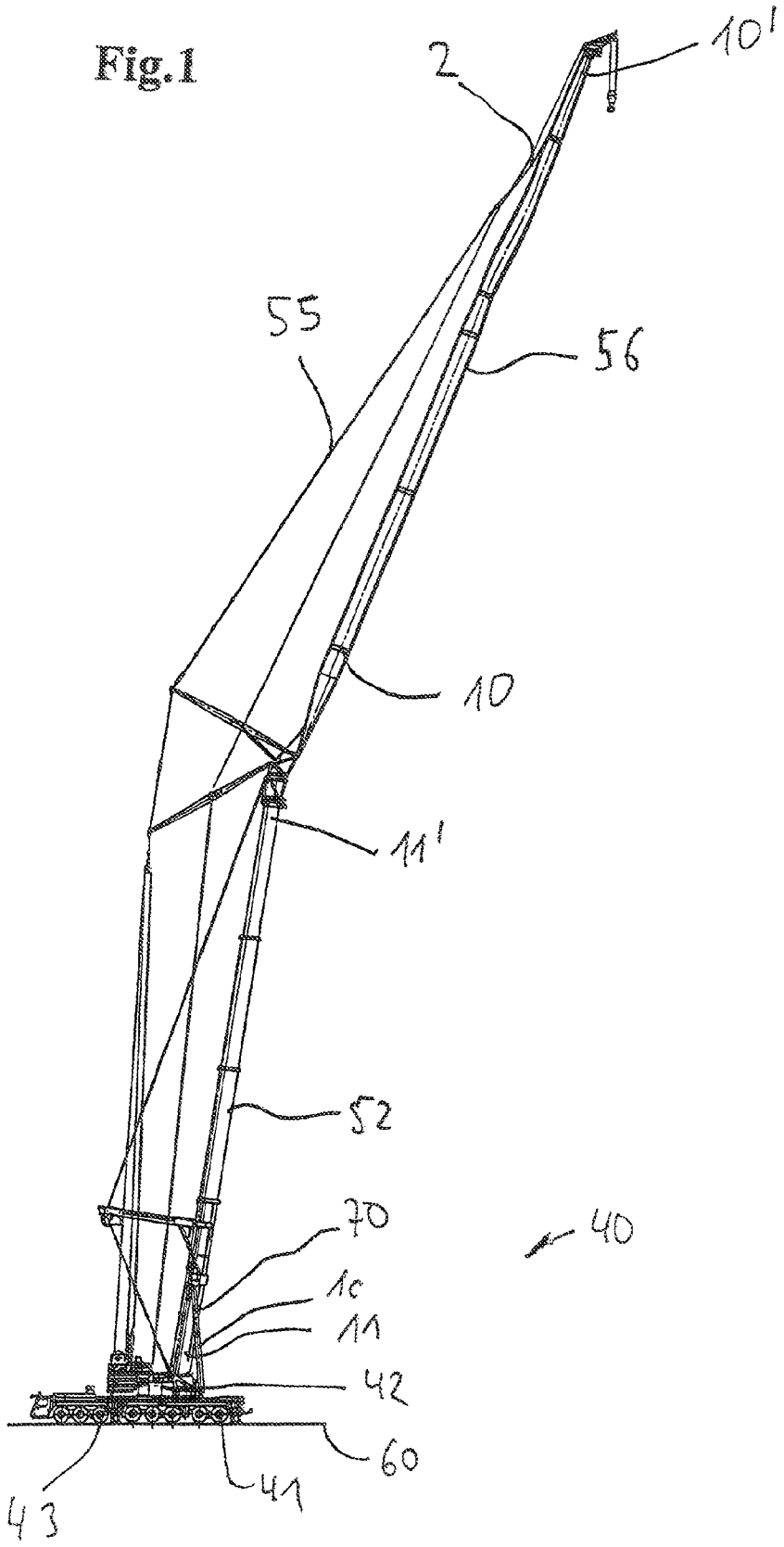
FIG. 1: a side view of the mobile crane in accordance with the invention with a telescopic boom and a crane control for carrying out the method in accordance with the invention.

FIG. 1 shows a mobile crane having a telescopic main boom 52 and a luffable fly boom 56 attached thereto. The main boom 52 can be luffed up about a horizontal luffing axis with the aid of the luffing ram 70. To determine the required holding force for the main boom 52, a load sensor 1*c* is arranged at the luffing ram 70 which is in communication with the crane control of the mobile crane.

A further load cell 2 is available in the region of the guying 55 of the luffing fly boom 56. The measured force values are likewise provided to the crane control.

Information on the crane configuration of the shown mobile crane selected and visible in FIG. 1 is available to the crane control used and was communicated to the crane control either before the start of the setup procedure by user input or was already programmed by presetting ex works. The taking into account of the named data has the result that the crane control only expects and uses for the subsequent evaluation measured data of the actually existing load cells relevant with respect to the crane configuration used. A crane control is naturally likewise conceivable with an automatic recognition of the crane configuration.

In addition to the load cells, existing angle transmitters in the boom system of the mobile crane are considered via whose signals one or more measured values for subsequent evaluation are provided to the crane control during the setup procedure. Since every boom deforms under load, a decisive role accrues to the angular data in the monitoring of the material load during the setup procedure.

For this purpose, the crane control utilizes the angle meters 11, 11' provided in the main boom 52 and the angle meters 10, 10' fastened in the luffing fly boom 56. The angle of the movable boom elements can be set into relation to the horizontal 60 as the reference line via these angle meters and can be evaluated by the control.

A sensor is furthermore provided for determining the wind strength. Optionally, the current angular position of the undercarriage 41 can be detected during the setup procedure and transmitted to the control.

The crane control, in particular the load moment limitation of the crane, now uses the values delivered by the sensors indicated above to secure the crane safety as much as possible during setup. The crane control receives one or more tables having matching limit values for all measured points as a new input which may not be exceeded during the setup. These tables are stored in a memory of the crane control.

There is the possibility that the table either provides all the limit values on all boom combinations or boom positions, which, however, may result in an unmanageable flood of data due to the high number of possible combinations and positions. For this case, a calculation method is known the crane control which determines the residual and urgently required limit values dependent on the set up state with sufficient precision by interpolation from the existing basic limit values. It is thus possible effectively to compare a measured and calculated state for every point of time during the total setup procedure.

The individual method steps of the present invention can be summarized as follows:

1. Data on the current crane configuration are provided to the crane control. These data in particular include information with respect to the used ballast 43 on the revolving deck 42 as well as further characteristic values such as the crane weight or the footprint of the crane.
2. The required holding force in the telescopic boom 52 is detected via the load cell 1*c* and delivers current measured values continuously to the crane control during the setup procedure.
3. All angle transmitters 10, 10', 11, 11' provide the crane control continuously with current measured values which can in particular also include rather improbable negative angles for the regular crane operation. A negative angle is related to the horizontal plane 60.
4. In addition, further sensor values can be used for the characterization of the wind strength as well as, for example, the measured values of an inclination sensor which describes the current inclination of the crane.
5. The matching limit values are taken from the stored table in the crane control and further limit values depending on the setup state are calculated by interpolation as required from the existing sampling points of the table.
6. A comparison is made of the respective delivered actual values of the load cells and of the individual angle sensors with the matching limit values for the current setup state which are above all selected in dependence on the current crane position, in particular the boom position.
7. A suitable measure is optionally taken by the control as a response to the comparison. For example, a potential risk of tilt or of a material overload can be prevented by reducing the movement speed of the crane during the setup procedure down to stopping the current crane movement. It is also possible to output an optical warning signal, in particular a yellow or red warning signal, which is optionally amplified by an acoustic warning sound.

Figure 2:
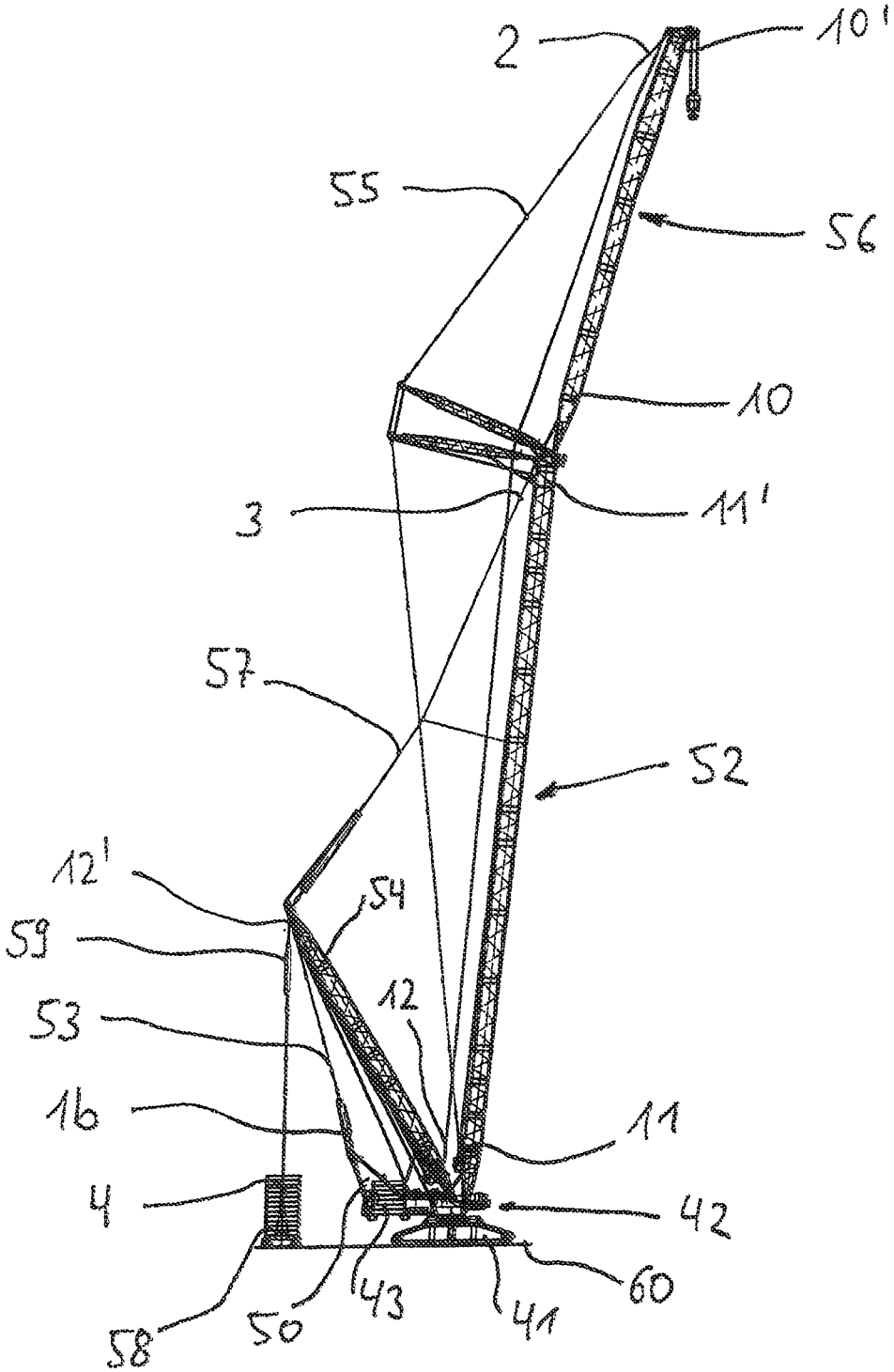
FIG. 2: a side view of a crawler-mounted crane with a lattice boom and a derrick boom as well as a crane control for carrying out the method in accordance with the invention.

The method in accordance with the invention can be carried out independently of the selected configuration. FIG. 2 shows a crawler-mounted crane having a main lattice boom 52 and a luffable fly boom 56. In this crane configuration, the load cell 1*b* in the guying 53 toward the derrick boom 54 is used for determining the holding force.

The load cell 2, as in the embodiment of FIG. 1, likewise determines the force in the guying 55 of the luffing fly boom 56. In addition, the load cell 3 is provided which specifically determines the force in the guying 57 toward the luffing rope combination of the main boom 52 in derrick operation.

The load cell 4 which is very important for an operation with derrick ballast detects the force which the derrick ballast 58 introduces into the derrick boom 54. The derrick ballast 58 can have a ballast box or also the suspended ballast shown in the drawing. The force is transmitted via cylinders 59 since the ballast box may not raise from the ground and the spacing from the derrick head to the suspended ballast must be variable.

With respect to the taking into account of the measured values of the individual angular sensors 10, 10', 11, 11', the crawler-mounted crane of FIG. 2 has an additional angle meter 12, 12' at the derrick boom 54 which determines the current angle of the derrick boom 54 with respect to the horizontal.

The other crane elements relevant to the method correspond to those of the crane of FIG. 1 and are consequently characterized by identical reference numerals. The process of the method in accordance with the invention is carried out by the crane control of the crane shown in FIG. 2 in accordance with the preceding explanation on the crane of FIG. 1, with in this case the measured values of the corresponding load cells or sensors of the crane of FIG. 2 being used.

In addition, the method in accordance with the invention allows a securing of the crawler-mounted crane shown against too large a ground pressure for which purpose the knowledge of individual geometrical data within the crane control is a requirement. In detail, the crane control knows the exact footprint one the basis of the known crawler geometry which is advised as a rule by preceding user input and is provided with information on the applied forces and torques by the transmission of the individual sensor values to the crane control, with the missing values for the calculation of the ground pressure being derived from the existing crane configuration. These include, for example, the used central ballast as well as other inherent weights of the crane. The crane control can determine the current ground pressure during the setup process on the basis of the named information and can display it in the crane cabin.

Figure 4:
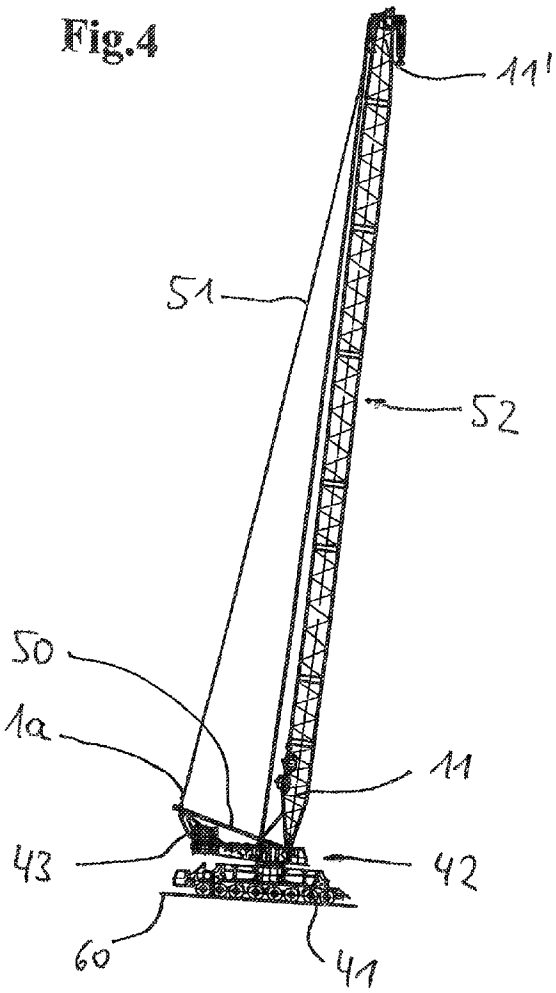
FIG. 4: a side view of a mobile crane with a lattice boom and a crane control for carrying out the method in accordance with the invention.
Figure 3:
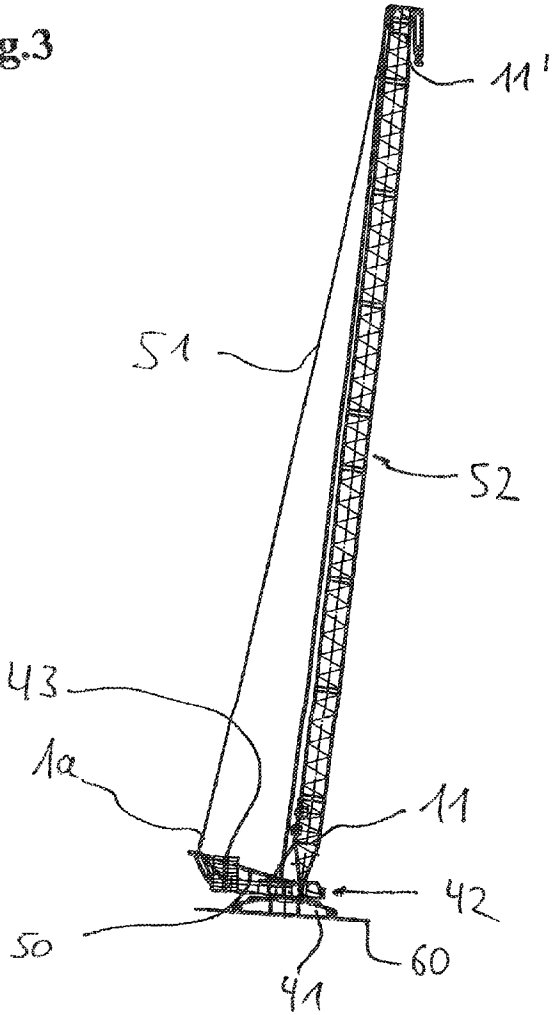
FIG. 3: a side view of a further crawler-mounted crane with a lattice boom and a crane control for carrying out the method in accordance with the invention.

FIGS. 3 and 4 show a possible crane configuration with a crawler-mounted crane with a lattice boom 52 being shown, on the one hand, and a mobile crane with a mounted lattice boom 52 being illustrated in FIG. 4. In this crane configuration, the holding force introduced into the main boom 52 is determined via the load cell 1*a* in the guying 51 toward the main boom. In addition to the force measurement, an angular measurement of the main boom with respect to the horizontal takes place with the aid of the angle sensors 11, 11'. In comparison with the preceding embodiments of FIGS. 1 and 2, only the measured data of the load cell 1*a* as well as the measured data of the angle sensors 11, 11' are used for the carrying out of the method, if necessary while optionally using the measured values of a wind sensor as well as of a further inclination sensor.

Since a force present in the crane is monitored directly against the theoretically calculated limit value, a maximum precision in the crane monitoring can be ensured. For example, an additional weight at the boom system which is possibly caused by ice formation can be reliably recognized and can under certain circumstances result in the output of various warning signals or in the aborting of the setup procedure. Security against an erroneous input of the information with respect to the hook-type bottom block used can be provided since the method determines the force actually introduced into the crane and deviations with respect to the force values expected due to the incorrect input are immediately recognized.

A fast and safe planning of the crane deployment is necessary for a crane deployment. The planning lays down which boom combination, in particular with respect to the selected boom length and the possible load of the boom system is selected and which ballast weight is required for the crane deployment.

It may, however, occur that a greater ballast weight is required for erecting the required boom combination than for the crane work itself. It is thus of advantage if the complete setup procedure is also included in the planning of the crane deployment. Otherwise, it might occur under certain circumstances, that the boom combination cannot be erected with the ballast present on the construction site. It is necessary for this purpose to calculate back to the weights e.g. of the main boom and the hook-type bottom block from the calculated maximum permitted forces.

Figure 5:
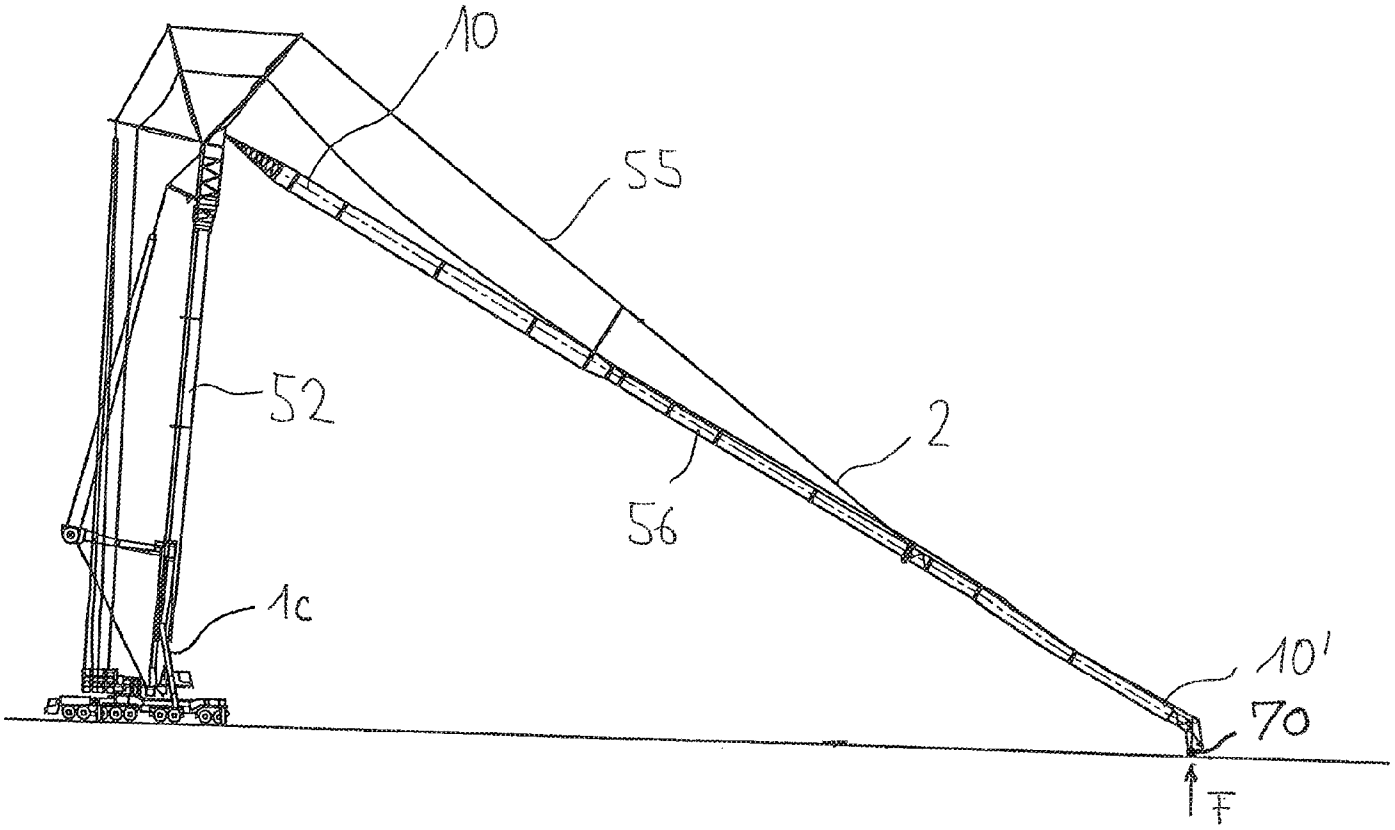
FIG. 5 a side view of a mobile crane with a long fly boom and a crane control for carrying out the method in accordance with the invention.

A crane configuration having a fly boom 56 during the erection is shown in FIG. 5. The fly boom 56 is placed on a trolley 70 here. The forces are detected at 1*c* and 2 and supplied to the control. The angle-related method in accordance with the invention additionally allows the monitoring of the minimal and maximum support load on the trolley 70 to the fly boom 56. The support force taken up by the trolley 70 can here be determined from the measured values at 2 and 1*c*. This support force is, for example, essential for the lateral guidance of the boom system and for the sagging of the guying rods 55.

The invention claimed is:

1. A method of monitoring crane safety during the setup procedure of a crane, comprising the steps of providing the crane with a sensor system and a crane control, assembling the crane from a transport state into a working state including luffing up a boom of the crane, as the crane is being assembled and the boom luffed up, prior to the crane being in a payload table applicable to usage, sensing at least one angular position of components being raised or assembled by the sensor system as one or more measured values, directing the one or more measured values to the crane control which receives the one or more measured values from the sensor system during the setup procedure, comparing the measured value or values received by the crane control with at least one corresponding angle-related limit value, and triggering a response on exceeding and/or falling below the limit value.

2. A method in accordance with claim 1, wherein one or more limit values dependent on a setup state are stored in a table and can be called up and the measured value or values are compared with the respective limit value or values dependent on the setup state.

3. A method in accordance with claim 1, wherein one or more limit values dependent on a setup state are calculated using one or more stored limit values and are in particular determined based on an interpolation method.

4. A method in accordance with claim 1, wherein a holding force at a movable boom element is determined as the measured value by the sensor system and is transmitted to the crane control.

5. A method in accordance with claim 4, wherein the holding force in guying toward a main boom and/or in guying toward a derrick boom or in a telescopic boom is determined as the measured value by the sensor system, in particular at or in a region of a luffing ram of the telescopic boom.

6. A method in accordance with claim 1, wherein a force in guying toward a luffing fly boom and/or in guying toward a luffing rope assembly of a main boom is determined as the measured value by the sensor system and is transmitted to the crane control.

7. A method in accordance with claim 1, wherein a force which a derrick ballast introduces into a derrick boom is determined as the measured value by the sensor system in crane operation with the derrick boom and is transmitted to the crane control.

8. A method in accordance with claim 1, wherein angular position of one or more crane elements, in particular boom elements, are determined as the measured value by the sensor system and are communicated to the crane control, with at least one angle toward the horizontal being determined as a reference line.

9. A method in accordance with claim 8, wherein the angular position of a main boom and/or of a luffing fly boom and/or of a derrick boom and/or of an undercarriage is determined.

10. A method in accordance with claim 1, wherein wind strength is determined as the measured value by the sensor system and is communicated to the crane control.

11. A method in accordance with claim 1, wherein data with respect to planned crane configuration, in particular with respect to crane ballast and/or to crane weight and/or to crane footprint and/or to boom combination are known to the crane control and the crane control only uses for subsequent evaluation, measured values from the sensor system relevant to this crane configuration, during the setup procedure.

12. A method in accordance with claim 1, wherein a speed reduction and/or an emergency stop of at least one crane movement takes place as a measure during the setup procedure and/or output of at least one acoustic and/or optical warning signal takes place.

13. A method in accordance with claim 1, wherein the crane control recognizes and, where applicable, indicates risk of tilting and/or a material overload and/or an exceeding of permitted ground pressure and shows a corresponding response.

14. A method in accordance with claim 1, wherein the crane control processes the measured value or values relating to holding force and converts it/them to an actual payload; and the crane control converts an associated angle-related maximum permitted limit value to a maximum possible payload and then displays at least one value, in particular in the form of a capacity bar.

15. A method in accordance with claim 14, wherein the control displays both the maximum permitted angle-related limit value and the maximum possible payload value in relation to one another.

16. A crane, in particular a mobile crane or crawler mounted crane with a telescopic boom or lattice boom, having a sensor system and a crane control for carrying out the method in accordance with claim 1, wherein the sensor system includes one or more load cells and/or angle/meters and/or wind gauges arranged at the crane which communicate with the crane control.

17. A method in accordance with claim 1, comprising the additional steps of positioning angle meters (11, 11') on a main boom (52) and fastening angle meters (10, 10') to a luffing fly boom (56), and setting angle of movable boom elements in relation to horizontal (60) as a reference line via the angle meters (11, 11', 10, 10').

18. A method in accordance with claim 17, comprising the additional step of positioning angle meters (12, 12') on a derrick boom (52) to determine angle of the derrick boom (52) in relation to the horizontal (60).

19. A method in accordance with claim 1, comprising the additional steps of determining wind strength with a sensor and/or current angular position of an undercarriage (41) during the setup procedure and transmitting the same to the crane control.

20. A method in accordance with claim 1, comprising the additional steps of determining holding force introduced into a main lattice boom (52) of a crawler-mounted or mobile crane via a load cell (1*a*) in guying (51) toward the main lattice boom (52), and measuring angular position of the main lattice boom (52) with respect to horizontal (60) by angle sensors (11, 11') positioned on the main lattice boom (52).

21. A method in accordance with claim 20, comprising the additional steps of placing a fly boom (56) on a trolley (70), and determining support force taken up by the trolley (70) during erection from the measured values (2, 1*c*) of the holding force in the guying and angular position of the main boom (52), to monitor minimum and maximum support load on the trolley (70) to the fly boom (56).

22. A method' in accordance with claim 1, comprising the additional step of guying (51) the boom (52) into position as the boom (52) is being luffed up and the crane assembled, and said sensing step comprising sensing load on the guying (51) as the boom (52) is being luffed up.

* * * * *